US007608311B2

(12) United States Patent
Snow

(10) Patent No.: US 7,608,311 B2
(45) **Date of Patent: *Oct. 27, 2009**

(54) PRINT RECEPTIVE ARTICLES

(75) Inventor: Larry Glen Snow, Leroy, NY (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 557 days.

This patent is subject to a terminal disclaimer.

(21) Appl. No.: 10/980,047

(22) Filed: Nov. 3, 2004

(65) Prior Publication Data

US 2005/0129883 A1 Jun. 16, 2005

Related U.S. Application Data

(60) Provisional application No. 60/530,085, filed on Dec. 16, 2003.

(51) Int. Cl.
*B41M 5/50* (2006.01)

(52) U.S. Cl. ..... 428/32.26; 428/32.31

(58) Field of Classification Search ..... None
See application file for complete search history.

(56) References Cited

U.S. PATENT DOCUMENTS

| | | | | |
|---|---|---|---|---|
| 2,419,008 | A | 4/1947 | Coffman et al. | |
| 2,510,783 | A | 6/1950 | Johnston et al. | |
| 2,599,300 | A | 6/1952 | Upson | |
| 2,953,818 | A | 9/1960 | Bartron | |
| 3,133,854 | A * | 5/1964 | Simms | 428/421 |
| 3,139,470 | A | 6/1964 | Prengle et al. | |
| 3,524,906 | A | 8/1970 | Schmitt et al. | |
| 4,931,324 | A | 6/1990 | Ellison et al. | |
| 5,707,697 | A | 1/1998 | Spain et al. | |
| 6,626,530 | B2 | 9/2003 | Snow et al. | |
| 2002/0150734 | A1 | 10/2002 | Snow et al. | |
| 2002/0176970 | A1 | 11/2002 | Kobayashi et al. | |
| 2003/0211293 | A1 | 11/2003 | Nemoto et al. | |

FOREIGN PATENT DOCUMENTS

| | | |
|---|---|---|
| WO | WO 03/002352 A | 1/2003 |

* cited by examiner

*Primary Examiner*—Bruce H Hess

(57) ABSTRACT

This invention provides printed and print receptive articles and processes for making such articles. The articles have a substrate coated with hydrophobic, ink receptive polymer composition characterized by a solvent resistant fraction of at least about 0.6 and a solvent absorbance capacity of at least about 300%.

31 Claims, No Drawings

PRINT RECEPTIVE ARTICLES

FIELD OF INVENTION

This invention relates to printed and print receptive articles and processes for making such articles.

BACKGROUND OF THE INVENTION

Many advances have been made in the production of signage for both indoor and outdoor applications. Printing techniques such as digital ink jet printing allow for the production of high quality color images for a wide range of applications at a low cost. Printable substrates such as fluoropolymer films have been selected that can withstand the effects of dirt, stains, graffiti, sun and other vicissitudes of weather and handling. Moreover, as described in U.S. Pat. No. 6,626,530 to Snow et al., printing with solvent based inks has been employed, eliminating the need for water absorbing layers needed for printing with aqueous based inks. Printing on fluoropolymer films is accomplished in U.S. Pat. No. 6,626,530 by coating the films with a hydrophobic, ink receptive compositions compatible with the fluoropolymer film. The ink receptive compositions enable the printing of images on substrates known for having low surface energy with good release properties.

Solvent-based digital printers utilize low viscosity inks in order to facilitate fluid movement of ink through the print heads. This leads to relatively low concentrations of solid pigment and other additives and, typically, inks are around 10 wt. % solids. Low solids inks necessitate the jetting of high volumes of ink solvent to achieve bright colors. The problem magnifies when multiple ink streams are mixed to achieve a broader color range or more intensely colored regions. Printers commonly use four different inks (cyan, magenta, yellow and black) and more sophisticated printers use as many as eight with a corresponding increase in use of ink solvent per square foot to achieve intensely colored regions.

Ink receptive coatings must be able to accommodate large volumes of ink solvent associated with solvent-based printing to produce intense colors. Use of a single ink jet stream may yield up to 1 ml ink solvent per square foot of ink receptive coating, while the production of an intense solid black image which requires all four ink jet streams in a four color printer will yield up to 4 ml per square foot. If the dry film thickness (dft) of a coating is 25 micrometers, it must absorb roughly 1.7 times its own weight of ink solvent to accommodate the maximum ink output of a four color printer. In many applications thinner ink receptive coatings are desirable, i.e., coatings having a dft of 5 to 10 micrometers are common. A coating of 5 micrometers needs to accommodate more than 8 times its own weight of ink solvent to perform the same function.

There is a need for printable articles having an ink receptive composition for use with non-aqueous solvent based inks that can absorb significantly more ink solvent without adverse effects such as crazing or dissolution.

BRIEF SUMMARY OF THE INVENTION

The present invention relates to a printable article having a substrate coated with hydrophobic, ink receptive polymer composition characterized by a solvent resistant fraction of at least about 0.6 and a solvent absorbance capacity of at least about 300%.

In preferred embodiments, the ink receptive composition is a crosslinked polymer, preferably a crosslinked amine functional acrylic copolymer. In preferred embodiments the substrate of the printed article is polymer, metal, glass or paper, preferably polymer film. Printable articles wherein the substrate is a fluoropolymer are especially preferred.

The invention further provides a printed article having a substrate coated with a layer of hydrophobic, ink receptive polymer composition characterized by a solvent resistant fraction of at least about 0.6 and a solvent absorbance capacity of at least about 300%, and an image formed on the layer by a non-aqueous solvent based ink.

The present invention also provides a process for preparing both the printable article and the printed article.

DETAILED DESCRIPTION OF THE INVENTION

Hydrophobic, Ink Receptive Polymer Compositions

The hydrophobic, ink receptive polymer compositions used as coatings for printable articles and printed articles in accordance with the present invention generally have properties as taught in U.S. Pat. No. 6,626,530 to Snow et al. for achieving high quality printed articles using non-aqueous solvent based inks. As explained in more detail hereinafter, a variety of different polymer systems can be employed in the hydrophobic ink receptive polymer compositions to provide effective wetting by non-aqueous solvent based inks followed by sufficient absorption of the solvent to fix the ink without causing crazing or complete solution of the polymer coating.

To meet the demands of today's more sophisticated printers which have additional ink colors and/or achieve images in more diverse colors and of stronger intensity, hydrophobic ink receptive polymer compositions for use in accordance with the present invention are characterized by a solvent resistant fraction of at least about 0.6 and a solvent absorbance capacity of at least 300%. Solvent absorbance capacity is a measure of how well the hydrophobic, ink receptive polymer coating is able to absorb the ink solvent. The solvent resistant fraction is a measure of how well the hydrophobic, ink receptive polymer coating resists destruction by the ink solvent.

Both solvent resistant fraction and solvent absorbance capacity are determined by a procedure which involves coating glass slides with the ink receptive composition, immersing the slide in a standard solvent, drying, and characterizing the coating interaction with ink solvent by taking weight measurements during the procedure. The solvent resistant fraction is determined from the dry weight of the coating before and after the solvent treatment, i.e., indicates the fraction of the coating which is retained on the slide after solvent treatment. Solvent absorbance capacity is based on the solvent swollen weight of the coating in relation to the dry weight of the coating after solvent treatment, i.e., the indicates the solvent absorbance capacity of the solvent resistant fraction. The procedure is detailed later in the specification in the section titled Test Methods. The standard solvent used is 2-butoxyethyl acetate which is found to be a reasonable predictor for the coating interaction of most non-aqueous solvent based inks with hydrophobic ink-receptive coatings.

The solvent resistant fraction is preferably at least about 0.7, more preferably at least about 0.8, and even more preferably at least about 0.9. The solvent absorbance capacity is preferably at least about 400%, more preferably at least about 500%, and even more preferably at least about 600%. In an especially preferred embodiment, the hydrophobic, ink receptive polymer compositions used as coatings in this invention are characterized by a solvent resistant fraction of at least about 0.6 and a solvent absorbance capacity of at least about 800%.

In hydrophobic ink receptive coatings which have the solvent resistant fraction and solvent absorbance in accordance with the invention are advantageously provided by selecting any of a variety of suitable base polymers having the appropriate properties, and which have been crosslinked, in accordance with the following three factors:

1) The solubility characteristics of the base polymer of the ink receptive polymer coating preferably match those of the ink solvent. In the absence of crosslinking, the base polymer of the coating preferably dissolves readily into the ink solvent. This insures that the ink receptive polymer coating can be effectively wet by the solvent of the non-aqueous solvent based ink. Without sufficient wetting, the ink will attempt to minimize contact with the surface area leaving defects in the deposited image.

2) The base polymer of the ink receptive polymer coating preferably has a glass transition temperature (Tg) near or below the desired printing temperature in order to facilitate rapid absorbance of the ink solvent to achieve ink fixing. Sufficient absorption causes fixing of the printed dots in the positions as intended and prevents the merging of numerous dots into puddles that upon drying produce a distorted blurry image. Preferred Tg of the base polymer is from about 20° C. to about 60° C. for use in most printers.

3) The ink receptive polymer coating is preferably lightly crosslinked in order to prevent crazing or complete solution. If crazing occurs, the fractures in the coating will allow substrate to show through the image muting the crispness of the colors. If the coating dissolves, the fluoropolymer may be exposed and dewetting phenomena may occur. Further, if solution of the coating polymer into the ink occurs, the coating polymer may interact adversely with the ink dispersion quality causing pigment flocculation and the accompanying loss of color strength. Covalent crosslinks are preferred as they are more readily manipulated but crystalline crosslinks may be used as well.

For the practice of the present invention, the level of crosslinking of the base polymer is preferably carefully controlled because the solvent absorbance capacity is also sensitive to crosslink density. Additional crosslinking beyond that required to prevent crazing or complete solution limits the amount of ink solvent that can be absorbed. While it is desirable to have both a high solvent resistant fraction and a high solvent absorption capacity, this may be difficult to achieve with some polymer systems. With such systems, it usually is preferable to limit the crosslinking to retain a desired high solvent absorption capacity together with a more moderate, yet adequate solvent resistant fraction of at least 0.6.

It is also preferable in the practice of the present invention to employ a crosslinking agent and manufacturing process for the production of printable articles so that the crosslinking reaction substantially goes to completion during the manufacturing process. If the crosslinking reaction is incomplete during manufacture of the printable article and continues afterward, the product will not be stable and its properties will change over time. For example, its solvent absorbance capacity will decrease as the level of crosslinking increases. The most desirable situation is to control the extent of crosslinking by selecting the amount of crosslinker needed and causing substantially complete reaction during processing. In preferred embodiments of this invention, the solvent absorbance capacity of the hydrophobic ink receptive polymer composition does not decrease by more than 25% over a seven day period and preferably does not decrease by more than 10% over a seven day period.

In preferred embodiments of this invention, the ink receptive coating compositions used herein are able to handle the demands of 4-color and 8-color printers with coatings as thin as from 5 to 10 micrometers (dft) by absorbing 8 or more times their own weight of ink solvent thereby enabling the production of intensely bright colored images with good image clarity.

The principles of the present invention are best illustrated by using preferred hydrophobic ink receptive polymer compositions of amine functional polymers, more preferably amine functional acrylic polymers, most preferably amine functional acrylic copolymers. These polymers are preferably crosslinked as will be explained in more detail hereinafter.

The amine functional polymers useful for this invention may include but are not limited to acrylic polymers, polyamides, polyurethanes, polyesters, polyaziridines, and epoxy polymers. One preferred form of the amine functional polymer is an amine functional acrylic copolymer described in U.S. Pat. No. 3,133,854 to Simms. These amine functional acrylic copolymers comprise a vinyl addition polymer having substituents each bearing a hydroxyl radical and an amino radical bonded to adjacent carbon atoms. The amino radical bears at least one active hydrogen atom and the amino radicals in the substituents contain from 0.01 to 1.0% amino nitrogen based on the weight of the polymer. Preferably, such vinyl addition polymers are prepared by copolymerizing one or more ethylenically unsaturated monomers with a small portion of monomer containing pendent epoxy substituents, for example, by well known methods of bulk, solution, emulsion or granular polymerization in the presence of free radical catalysts. The resulting copolymer is then reacted with ammonia or a primary monoamine to yield the polymers used herein. Alternately, ammonia or a primary monoamine can be reacted with an ethylenically unsaturated monomer containing a pendent epoxy substituent and the resulting ammoniated or aminated monomer copolymerized with another, and epoxy-free, vinyl monomer.

Examples of vinyl monomers which can be used as the major constituent of the vinyl polymers used in the ink receptive compositions of this invention are derivatives of alpha, beta-unsaturated acids including methyl acrylate, ethyl acrylate, cyclohexyl acrylate, benzyl acrylate, naphthyl acrylate, octyl acrylate, tertiary-butyl acrylate, methyl methacrylate, ethyl methacrylate, butyl methacrylate, octyl methacrylate, stearyl methacrylate, butyl ethacrylate, ethyl alpha-chloroacrylate, ethyl alpha-phenylacrylate, dimethyl itaconate, ethyl alpha-methoxy acrylate, propyl alpha-cyanoacrylate, hexyl alpha-methylthioacrylate, cyclohexyl alpha-phenylsulfonyl acrylate, tertiarybutyl ethacrylate, ethyl crotonate, 2-hydroxypropyl acrylate, 2-hydroxypropyl methacrylate, 2-hydroxyethyl acrylate, 2-hydroxyethyl methacrylate, n-butyl acrylate, 2-ethylhexyl acrylate, 2-ethylhexyl methacrylate, lauryl acrylate, lauryl methacrylate, dimethyl maleate, isopropyl cinnamate, butyl beta-methoxyacrylate, cyclohexyl beta-chloroacrylate, acrylamide, alpha-phenylacrylamide, methacrylamide, N,N-dimethylacrylamide, N-cyclohexylmethacrylamide, itaconamide, acrylonitrile, crotonitrile, alpha-chloroacrylonitrile, methacrylonitrile, alpha-phenylacrylonitrile, N-phenyl maleimide, N-butyl itaconimide and mixtures thereof; vinyl derivatives such as vinyl acetate, vinyl benzoate, vinyl pimelate, vinyl stearate, vinyl methyl ether, vinyl butyl either, vinyl phenyl sulfide, vinyl dodecyl sulfide, vinyl butyl sulfone, vinyl cyclohexyl sulfone, vinyl chloride, vinyl fluoride, N-vinyl benzenesulfonamide, N-vinyl acetamide, N-vinyl caprolactam, styrene and vinyl toluene; allyl derivates such as allyl phenyl ether, allyl cyclohexylacetate. N,N-dimethylallylamine, ethyl allyloxyacetate, allylbenzene, allyl cyanide and allyl ethyl sulfide; methylene type derivates such a diethyl methylenemalonate, diketene, ethylene glycol ketene acetal, methylene cyclopentane, vinylidene chloride and vinylidene disulfones; miscellaneous compounds such as vinylene carbonate, acrolein acetals, methyl vinyl ketones, vinyl phosphonates, allyl phosphonates, vinyl trialkoxysilanes; and mixtures thereof. Of the aforementioned, epoxy-free vinyl monomers, acrylic esters, particularly esters of acrylic and methacrylic acids with 1 to 8 carbon-atom alkyl-, aryl- or cyclo-aliphatic alcohols are preferred.

Epoxy containing monomers that can be used in forming the composition are for example glycidyl methacrylate, glycidyl acrylate, allyl glycidyl ether, butadiene monoepoxide, vinyl-cyclohexene epoxide, glycidyl oxyethyl vinyl sulfide, glycidyl sorbate, glycidyl ricinoleate, glycidyl vinyl phthalate, glycidyl allyl phthalate, glycidyl allyl maleate, glycidyl vinyl ether, allyl alpha, beta-epoxyisovalerate and mixtures thereof. Glycidyl acrylate and methacrylate are particularly preferred because they can be copolymerized readily in small controlled amounts and the epoxy group introduced thereby reacts readily and substantially completely with ammonia and amines.

In the alternative, amine functional acrylic copolymers are formed by using acrylic acid or methacrylic acid in place of the epoxy containing monomers and reacting the acid with an aziridine to form a primary amine, preferably ethylene imine or propylene imine.

Especially preferred for this invention are primary amine functional acrylic copolymers, preferably monoalkyl amines of C8 or less. For example, methyl methacrylate/butyl methacrylate/2-hydroxy-3-aminopropyl methacrylate 32/64/4 copolymer or methyl methacrylate/butyl methacrylate/butyl acrylate/1-aminoisopropyl methacrylate (33/44/8/15).

As discussed above, preferred ink receptive polymer coatings are preferably cross-linked in order to prevent crazing or complete solution but crosslinking is limited so as to provide good solvent absorbance capacity. Preferred crosslink systems for amine functional polymers include epoxies and blocked isocyanates. An example of a preferred epoxy crosslinker is bisphenol-A diglycidyl ether (commercially available as Epon 828 from Ashland).

Especially preferred for use in this invention is a hydrophobic ink receptive composition of crosslinkable amine functional polymer and a polyfunctional isocyanate blocked by a blocking agent which, when coated on a substrate and heated to a sufficient temperature to deblock the blocked polyfunctional isocyanate, produces a crosslinked hydrophobic, ink receptive polymer layer on the substrate. The polyfunctional isocyanate is preferably selected from the group consisting of aromatic polyfunctional isocyanates, aliphatic polyfunctional isocyanates, and biuret trimers and isocyanurate trimers of the aliphatic and aromatic polyfunctional isocyanates. More preferably, the polyfunctional isocyanate is an aliphatic isocyanate selected from the group consisting of HMDI (hexamethylene diisocyanate) and IPDI (isophorone diisocyanate). In a preferred embodiment, the polyfunctional isocyanate is blocked by a blocking agent selected from the group consisting of diethyl malonate (DEM), diisopropyl amine (DIPA), methyl ethyl ketoxime (MEKO) and mixtures thereof. In an especially preferred embodiment the crosslinkable amine functional polymer is an amine functional acrylic copolymer and the polyfunctional isocyanate is an isocyanurate trimer of HMDI (hexamethylene diisocyanate) and blocking agents are selected from a group consisting of diethyl malonate (DEM), diisopropyl amine (DIPA) and mixtures thereof.

Polyfunctional isocyanates represent a class of compounds that are convenient for crosslinking polymers that contain active hydrogens such as alcohols and amines. In some instances the reaction between an isocyanate and an active hydrogen compound is so fast that it is impractical to mix the ingredients and then form a coating or other object. This is often the case when amines are the active hydrogen compound. In these circumstances the isocyanate can first be converted to another compound by reaction with a blocking agent. The masked isocyanate can then be mixed with the amine and manipulated as desired into a coating before the application of heat. When heat is applied, the masked isocyanate undergoes a reverse reaction that regenerates the isocyanate and liberates the blocking agent. The blocking agent is lost as a volatile and the regenerated isocyanate rapidly reacts with the amines to form the desired crosslinks.

The speed of the amine isocyanate reaction is attractive for making coatings that completely cure in a short period of time. When conditions for efficient deblocking of a blocked isocyanate are achieved, the amine isocyanate reaction will go to completion rapidly. For a product in which particular level of crosslinking is desirable such as the ink receptive coatings in accordance with the invention, this approach is advantageous. If the deblocking reaction can be forced to go substantially to completion in a drying oven, the amine isocyanate reaction will be substantially complete as well. This means that (1) the degree of crosslinking can be controlled simply by the amount of ingredients added to the mixture and (2) the crosslink density will be substantially the same on day 1 after manufacture as on day 100.

In order to prepare coatings on polymer films for ink reception, it is preferred that the coating can be fully cured within the range of about 0.5 to 2.0 minutes. This allows for full cure at normal coating line speeds of 50 to 200 ft/min. Accordingly, easily removed blocking agents are desirable. Preferred blocking agents are then, diethyl malonate (DEM), diisopropyl amine (DIPA) and methyl ethyl ketoxime (MEKO). Also, aliphatic polyfunctional isocyanates are preferred such as those based upon HMDI and IPDI as these will deblock more readily than the aromatic polyfunctional isocyanates. In particular, Desmodur BL-3370 available from Bayer (isocyanurate trimer of HMDI+DEM and DIPA blocking agents) is especially preferred.

Suitable solvents for application of the amine functional polymer to substrates are any of a variety of volatile solvents such as toluene, xylene, butanol, pentanol, isopropanol, cyclopentane, octane, ethoxythanol, and other aliphatic, cycloaliphatic, and aromatic hydrocarbons, alcohols, ethers and mixtures thereof. Concentration of the amine functional polymers in such solutions is usually about 10% to about 40% by weight. Any of a variety of coating methods may be used including, for example, spraying, dipping, roll coating, etc.

The ink receptive composition may contain one or more light stabilizers as additives and, when assembled into the article of this invention, a light stabilizer protects the printed image by reducing the damage caused by exposure to sun. Light stabilizer additives include compounds that absorb ultraviolet radiation such as hydroxybenzophenones and hydroxybenzotriazoles. Other possible light stabilizer additives include hindered amines light stabilizers (HALS) and antioxidants.

Substrates

The printable and printed articles of present invention may include a wide number of substrates. Preferably, the substrate is selected from a group consisting of polymer, metal, glass, and paper. In preferred embodiments, the substrate is a polymer film. Polymer film thickness can range from very thin to a thickness sufficient to confer the structural integrity of a polymer sheet.

In a more preferred embodiment, the polymer film is made of a polymer selected from the group consisting of polyester, polycarbonate, polyolefin, vinyl chloride polymer and fluoropolymer. Especially preferred for use in this invention is a substrate that is a fluoropolymer, especially a fluoropolymer that is selected from polymers and copolymers of trifluoroethylene, hexafluoropropylene, monochlorotrifluoroethylene, dichlorodifluoroethylene, tetrafluoroethylene, perfluorobutyl ethylene, perfluoro(alkyl vinyl ether), vinylidene fluoride, and vinyl fluoride and blends thereof and blends of the polymers with a nonfluoropolymer.

The fluoropolymer used for the substrate of this invention is preferably selected from polyvinyl fluoride, fluorinated ethylene/propylene copolymer, ethylene/tetrafluoroethylene copolymer, tetrafluoroethylene/perfluoro(alkyl vinyl ether) copolymer, polyvinylidene fluoride and a blend of polyvinylidene fluoride and an acrylic polymer. The present invention is preferably employed with polyvinyl fluoride (PVF) films.

The fluoropolymer film can be made from fluid compositions that are either (1) solutions or (2) dispersions of fluoropolymer. Films are formed from such solutions or dispersions of fluoropolymer by casting or extrusion processes. In the case of fluoropolymers that are melt processible, melt extrusion processes are possible. Both oriented and unoriented fluoropolymer films can be used in the practice of the present invention. Increased clarity is often achieved when printing occurs on cast, unoriented films.

Typical solutions or dispersions for polyvinylidene fluoride or copolymers of vinylidene fluoride are prepared using solvents that have boiling points high enough to avoid bubble formation during the film forming/drying process. The polymer concentration in these solutions or dispersions is adjusted to achieve a workable viscosity of the solution and in general is less than about 25% by weight of the solution. A suitable fluoropolymer film is formed from a blend of polyvinylidene fluoride, or copolymers and terpolymers thereof, and acrylic resin as the principal components as described in U.S. Pat. Nos. 3,524,906; 4,931,324; and 5,707,697.

In the preferred form of the invention using films of polyvinyl fluoride (PVF) as the substrate, suitable films can be prepared from dispersions of the fluoropolymer. The nature and preparation of such dispersions are described in detail in U.S. Pat. Nos. 2,419,008; 2,510,783; and 2,599,300. Suitable PVF dispersions can be formed in, for example, propylene carbonate, N-methylpyrrolidone, γ-butyrolactone, sulfolane, and dimethyl acetamide. The concentration of PVF in the dispersion will vary with the particular polymer and the process equipment and the conditions used. In general, the fluoropolymer will comprise from about 30 to about 45% by weight of the dispersion.

Films of polyvinyl fluoride may be formed by extrusion procedures such as those described in U.S. Pat. Nos. 3,139,470 and 2,953,818. These patents describe the feeding of polyvinyl fluoride dispersion to a heated extruder that is connected to a slotted casting hopper. A tough coalesced extrudate of polyvinyl fluoride is extruded continuously in the form of a film containing latent solvent. The film can be merely dried or, alternately, can be heated and stretched in one or more directions while the solvent is volatilized from the film. When stretching is used, oriented film is produced. Alternatively, films of polyvinyl fluoride can be cast from dilute dispersions of the polymer in latent solvent and unoriented films are produced.

In fluoropolymer film casting processes, the fluoropolymer is formed into its desired configuration by casting the dispersion onto a support, by using any suitable conventional means, such as spray, roll, knife, curtain, gravure coaters, or any other method that permits applying a substantially uniform film without streaks or other defects. The thickness of the cast dispersion is not critical, so long as the resulting film has sufficient thickness to be self-supporting and be satisfactorily removed from the substrate onto which the dispersion is cast. In general, a thickness of at least about 0.25 mil (6.4 μm) is satisfactory, and thicknesses of up to about 15 mils (381 μm) can be made by using the dispersion casting techniques of the present invention. A wide variety of supports can be used for casting films according to the present invention, depending on the particular polymer and the coalescing conditions. The surface onto which the dispersion is cast should be selected to provide easy removal of the finished film after it is coalesced. While any suitable support can be employed for casting the fluoropolymer dispersion, examples of suitable supports include polymeric films or steel belts.

After casting the fluoropolymer dispersion onto the support, the fluoropolymer is then heated to coalesce the fluoropolymer into a film. The conditions used to coalesce the polymer will vary with the polymer used, the thickness of the cast dispersion, among other operating conditions. Typically, when employing a PVF dispersion, oven temperatures of from about 340° F. (171° C.) to about 480° F. (249° C.) can be used to coalesce the film, and temperatures of about 380° F. (193° C.) to about 450° F. (232° C.) have been found to be particularly satisfactory. The oven temperatures, of course, are not representative of the temperatures of the polymer being treated, which will be lower. After coalescence, the finished film is stripped from the support by using any suitable conventional technique.

In a preferred embodiment, the surface of the fluoropolymer film is surface treated to enhance adherability. The surface treatment can be achieved by exposing the film to a gaseous Lewis acid, to sulfuric acid or to hot sodium hydroxide. Preferably, the surface can be treated by exposing one or both surfaces to an open flame while cooling the opposite surface. Treatment to enhance adherability can also be achieved by subjecting the film to a high frequency, spark discharge such as corona treatment. Additional treatments such as alkali metal bath treatments or ionizing radiation, e.g., electron beams, may also be useful.

Printers and Inks

The advantages of ink jet printing have been widely recognized. High quality color images can be produced for a wide range of applications at a low cost. The technology is extremely versatile permitting production of signs and displays of all sizes, including fliers, posters, banners and billboards. Images can be stored digitally and be modified easily and frequently.

The printable articles in accordance with the invention can be printed using ink jet printing processes that employ nonaqueous solvent-based inks. One particularly useful inkjet process that uses nonaqueous solvent-based ink is piezoelectric printing. Piezoelectric printing involves applying a voltage to a piezoelectric crystal to cause a pressure pulse in the printhead to emit droplets of ink. In a preferred embodiment, the printhead is operated by applying a voltage pulse to a piezoelectric crystal in contact with a supply of the nonaqueous solvent based ink resulting in generating a pressure pulse in the printhead for emission of the ink. A commercial piezoelectric inkjet printer useful in this invention is a VUTEk® UltraVu 2360 SC printer sold by VUTEk, Meredith, N.H.

The ink compositions for use in printing on the articles in accordance with the invention are non-aqueous and contain organic solvents. Mixed ether acetates derived from ethylene glycol, such as 2-butoxyethyl acetate (BEA), are common ink solvents. The printable articles in accordance with the invention can also be printed on using screen printing techniques which use nonaqueous solvent based inks or have a composition wherein monomers in the ink act as a solvent. Screen printing involves preparing a screen that will only allow ink to be forced through it in particular spots. Photomask technology is often used to block the screen with polymeric material in areas where passage of ink is not desired. In the areas where ink is desired, the screen is left as is. A squeegee or roll is then used to force ink through the screen. Color images are developed by the successive addition of different colored inks with an additional screen for each color desired.

Two basic types of screen printing inks are compatible with the present invention. The first of these are non-aqueous solvent based screen printing inks. These inks tend to utilize the same or similar mixed ether ester solvents derived from ethylene glycol or propylene glycol as do the digital ink jet inks (such as 2-butoxyethyl acetate). Higher viscosity in comparison to the ink jet inks is desirable in this case and as such solids levels are typically 30 to 50 weight percent.

The other category of screen printing ink that is accommodated by the present invention is UV cure screen printing inks. This type of ink eliminates volatile organic content by using monomers as solvent. Once the ink is passed through the screen it is cured by exposure to UV light. UV sensitive initiators are incorporated that initiate polymerization of the monomers thus converting the fluid ink into a polymeric film after printing. Common monomers for this process include 1,6-hexanediol diacrylate (Sartomer SR 238), dipropyleneglycol diacrylate (Sartomer SR 508) and neopentylglycol diacrylate (Sartomer SR 247). Each of these UV cure monomers are absorbed by coatings of the type described in this invention and result in attractive well bonded images after curing.

Process

Printable articles of this invention are preferably made by a process that includes (1) coating a substrate with a composition comprising a crosslinkable amine functional polymer and a crosslinking agent; and (2) heating the coated substrate to a sufficient temperature to produce a crosslinked hydrophobic, ink receptive polymer layer on the substrate wherein the hydrophobic, ink receptive polymer layer is characterized by a solvent resistant fraction of at least about 0.6 and a solvent absorbance capacity of at least 300%. Any of a variety of coating methods may be used including, for example, spraying, dipping, roll coating, etc.

In a more preferred embodiment, a printable article is prepared by (1) coating a substrate with a composition comprising a crosslinkable amine functional polymer and a polyfunctional isocyanate blocked by a blocking agent; and (2) heating the coated substrate to a sufficient temperature to deblock the blocked polyfunctional isocyanate and thereby produce a crosslinked hydrophobic, ink receptive polymer layer on the substrate.

In a preferred embodiment in which the substrate is a fluoropolymer film, the hydrophobic ink receptive composition is coated on a fluoropolymer film that preferably has been activated to improve adhesion. Preferably, coating is accomplished by applying to at least one surface of the film a solution of the hydrophobic ink receptive composition to form a layer, when dried, of from 1-50 μm thick, more preferably 2.5-8 μm thick, of hydrophobic ink receptive composition. The coated fluoropolymer film is passed through an oven of approximate temperature of from 100 to 400° F. (38 to 204° C.) which dries the composition to form a coated film and thereby confers ease of handling, because the coated film can be rolled and stored or shipped in roll form if desired.

Printed Articles

Printed articles of this invention are made by forming an image on the surface of a substrate having a layer of hydrophobic, ink receptive composition characterized by a solvent resistant fraction of at least about 0.6 and a solvent absorbance capacitance of at least 300% as described above. The image is preferably formed using an inkjet printer or in an alternate embodiment, a screen printer.

Test Methods

Procedure for Determining Solvent Resistant Fraction and Solvent Absorbance Capacity Characterizing coating interactions with ink solvents is accomplished by applying coatings to glass slides, immersing the coated slides into the ink solvent determining the solvent resistant fraction and solvent absorbance capacity as described in the steps below. The solvent used for this procedure is 2-butoxyethyl acetate (2-BEA).

1. The glass slide is preweighed. (A=glass slide weight)
2. A coating is applied to the pre-weighed glass slide and then the slide is weighed to determine starting coating weight (B=coated slide weight).
3. The coated glass slide is immersed in the ink solvent for a predetermined time (usually 10 minutes unless otherwise specified).
4. The slide is removed from the solvent, wiped to remove excess solvent and then weighed to determine the solvent swollen weight (C=solvent swollen weight).
5. The coated slide is baked (usually 60 minutes at 120° C. unless otherwise specified) and reweigh (D=dried sample weight).
6. The solvent resistance coating fraction is determined by the following relationship of weights:

$$\text{Solvent Resistant Fraction}=(D-A)/(B-A) \quad (1)$$

7. The solvent absorbance capacity (weight of absorbed ink solvent per solvent resistance coating weight) is determined by the following relationship of weights:

$$\text{Solvent Absorbance Capacity}=(C-D)/(D-A)\times 100 \quad (2)$$

Tape Adhesion Test

A strip of aggressive PSA tape (transparent 3M Brand No. 467 PSA tape), 0.75 by 2.16 inch (1.9 by 5.5 cm), is pressed firmly over the printed area and allowed to develop adhesion for 1 minute. The tape is then pulled off at a 90° angle rapidly but without jerking. Passing the test requires that no ink be removed with the tape.

EXAMPLES

Base Polymers

Polymer A (Available from DuPont as 68080)

Methyl Methacrylate/2-hydroxy-3-aminopropyl methacrylate (97.8/2.2)

Polymer B (Available from DuPont as 68040)

Methyl Methacrylate/Butyl Methacrylate/2-hydroxy-3-aminopropyl methacrylate (32/64/4)

Polymer C (Available from DuPont as 68070)

Methyl Methacrylate/Butyl Methacrylate/Butyl Acrylate/1-aminoisopropyl methacrylate (33/44/8/15)

TABLE 1

| Acrylic Copolymer | Tg (° C.) | Amine Concentration (moles/Kg of solid) | Amine Concentration (mole fraction total monomers) |
|---|---|---|---|
| Polymer A | 101 | 0.14 | .014 |
| Polymer B | 50 | 0.25 | .031 |
| Polymer C | 55 | 1.07 | .133 |

Example 1

Amine Functional Acrylic Copolymers Crosslinked with Blocked Isocyanates

Base polymer B is lightly crosslinked at 6 different levels as shown in Table 2 with a blocked isocyanate crosslinker, Desmodur BL 3370 available from Bayer. The crosslinker is an isocycyanurate trimer of hexamethylenediisocyante (HMDI) containing blocking agents diethyl malonate (DEM) and diisopropyl amine (DIPA). Using the procedure described above for characterizing coating interactions with ink solvents, the solvent resistant fraction and the solvent absorbance capacity (amount of 2-BEA absorbed per solvent resistance coating weight) are determined for various amount of crosslinker as shown in Table 2 and for the control sample 1-7 with no crosslinking.

The data shown in Table 2 demonstrate that less crosslinking leads to more solvent absorbance in relation to the amount of coating that resists dissolving during the 10 minute immersion. In this system, some crosslink density is needed to prevent the coating from dissolving and crazing. Sample 1-7, with no crosslinking, has low solvent resistance. Immersion testing in 2-butoxyethyl acetate shows that as little as 0.5 mole % of the blocked isocyanate crosslinker based upon amine concentration can produce ink receptive coating compositions having acceptable properties, i.e., a solvent resistant fraction of greater than about 0.6 and a solvent absorbance capacity of at least 300%.

TABLE 2

| Sample | Mole % Crosslinker* | Potential Mole % Monomers Crosslinked** | Solvent Resistant Fraction | Solvent Absorbance Capacity % |
|---|---|---|---|---|
| 1-1 | 3 | 0.093 | 0.82 | 500 |
| 1-2 | 2.5 | 0.078 | 0.80 | 570 |
| 1-3 | 2 | 0.062 | 0.79 | 560 |
| 1-4 | 1.5 | 0.047 | 0.78 | 640 |
| 1-5 | 1 | 0.031 | 0.77 | 740 |
| 1-6 | 0.5 | 0.016 | 0.76 | 850 |
| 1-7 | 0 | 0 | 0.45 | 1030 |

*Mole % blocked isocyanate groups based upon amine concentration
**At 100% crosslinker reaction, the percentage of total monomer units involved in crosslinking

Example 2

Amine Functional Acrylic Copolymers Crosslinked with Epoxy

Using the procedure described above for characterizing coating interactions with ink solvents, the solvent resistant fraction and the solvent absorbance capacity (amount of 2-BEA absorbed per solvent resistance coating weight) are determined for base polymers B and C using various amounts of bisphenol-A diglycidal ether crosslinker crosslinker (Epon 828 from Ashland) as shown in Table 3.

Crosslink density is adjusted to produce ink receptive coating compositions having properties in accordance with the present invention, i.e., a solvent resistant fraction of greater than about 0.6 and a solvent aborbance capacity of at least 300%. Use of no crosslinker in this system, samples 2-1 and 2-4, results in too low solvent resistance. Use of too much crosslinker results in insufficient solvent absorbance, e.g., samples 2-3 and 2-6. The low Tg's of polymer B (Tg 50° C.) and polymer C (Tg 55° C.),i.e., Tg's close to desired printing temperature, make the polymers more capable of absorbing ink rapidly but also make the polymer vulnerable to dissolving and crazing at high ink loadings if the proper crosslink density is not achieved.

TABLE 3

| Sample | Polymer | Epon 828 mole %* | Bake Time (minutes) | Solvent Resistant Fraction | Solvent Absorbance Capacity % |
|---|---|---|---|---|---|
| 1-1 | C | 0 | 60 | 0.20 | 445 |
| 2-2 | C | 0.12 | 60 | 0.89 | 430 |
| 2-3 | C | 1.00 | 60 | 0.91 | 268 |
| 2-4 | B | 0 | 60 | 0.35 | 972 |
| 2-5 | B | 0.05 | 60 | 0.85 | 776 |
| 2-6 | B | 1.00 | 60 | 0.96 | 235 |

*Mole % epoxy groups based on amine concentration

Example A

Amine Functional Acrylic Copolymer with High Tg

Using the procedure described above for characterizing coating interactions with ink solvents, the solvent resistant fraction and the solvent absorbance capacity (amount of 2-BEA absorbed per solvent resistance coating weight) are determined for base polymer A without crosslinker and using bisphenol-A diglycidal ether crosslinker (Epon 828 from Ashland) as shown in Table 4.

The behavior of Polymer A illustrates the ink absorption limitation of high Tg polymers. In this case, glass slides are coated with Polymer A with and without an equivalent of the epoxy crosslinker. Neither sample absorbs an appreciable amount of BEA under these conditions.

The high Tg (101° C.) of this ink receptive coating helps prevent dissolving or fracture of the coating because ink solvent evaporation is faster than coating dissolution but it also limits how much ink solvent may be accommodated. It has been found that at lower ink loading of less than or equal to about 1 ml per square foot, it prints well (at 5 to 8 micron thickness) but when more ink is applied individual dots spread out and merge with adjacent dots and puddles of ink result. Both color control and resolution are lost when individual dots collect together as puddles.

TABLE 4

| Sample | Polymer | Epon 828 mole % | Bake Time (minutes) | Solvent Resistant Fraction | Solvent Absorbance Capacity % |
|---|---|---|---|---|---|
| A-1 | A | 0 | 60 | 1.0 | 13 |
| A-2 | A | 100 | 60 | 0.99 | 15 |

*Mole % epoxy groups based on amine concentration

Example 3

Printed Articles Produced from PVF Film with Hydrophobic Ink Receptive Coating of Amine Functional Acrylic Copolymer Crosslinked with Blocked Isocyanates A printed article is produced by making a fluoropolymer film substrate (polyvinyl fluoride), coating the substrate with an amine functional acrylic copolymer and a polyfunctional isocyanate blocked by a blocking agent, heating the coated substrate to a sufficient temperature to deblock the isocyanate and form a crosslinked hydrophobic, ink receptive composition, and printing an image using an inkjet printhead supplied with a non-aqueous solvent based ink.

Fluoropolymer dispersion is formed by combining and mixing the ingredients listed below (parts are by weight) in a lightening mixer followed by dispersing the mixture in a Netzsch mill using glass beads.

| | |
|---|---|
| Poly(vinyl fluoride) | 35 parts |
| Propylene carbonate | 65 parts |
| TINUVIN ® 1130 UVA | 0.35 parts |
| TINUVIN ® 770 HALS | 0.1 parts |

A polyvinyl fluoride (PVF) film is made by casting the resulting dispersion onto a temporary polyethylene terephthalate (PET) carrier of approximately 3 mils using a reverse gravure process and a 35 TH (tri-helical) gravure roll. Once coated the wet dispersion is passed through a 3-stage air floatation oven at 80 ft (24 m) per minute. The first oven stage is set at 425° F. (218° C.) and the other 2 stages are set to 390° F. (199° C.). Upon exiting the oven, the film is corona discharge treated at 16 watt-minutes per square foot (1.5 watt-minutes per square meter). This process produces a 1 mil (25 μm) thick polyvinyl fluoride film possessing a surface treatment for bonding to an ink receptive composition.

An ink receptive coating solution is prepared by combining the following ingredients (parts are by weight) and stirring with a lightening mixer.

| | |
|---|---|
| Amine functional acrylic polymer solution* | 100 parts |
| TINUVIN ® 1130 UVA | 7.5 parts |
| DESMODUR BL 3370** | 1 mole %*** |

*Methyl methacrylate/butyl methacrylate/2-hydroxy-3-aminopropyl methacrylate 32/64/4 copolymer (Polymer B) in a solvent of toluene and isopropanol
**Isocyanurate trimer of hexamethylenediisocyante (HMDI) containing blocking agents diethyl malonate (DEM) and diisopropyl amine (DIPA).
***Mole % blocked isocyanate groups based on amine content The resulting solution is coated onto the corona discharge treated polyvinyl fluoride film using a reverse gravure process and a 34 TH gravure roll at a line speed of 100 feet (m) per minute through a three zone oven (200° F. (93° C.)/350° F./350° F.) to produce an ink receptive coating, 5 micrometers (dft). The film is capable of absorbing 8× the coating's weight in ink solvent (solvent absorbance capacity 800%).

The coated film is then used as a base for printing in a VUTEk® 2600 printer (VUTEk, Meredith N.H.). Printing at 50 ft (15 m) per hour with Inkware type 3 solvent based inks (containing 2-butoxyethyl acetate), having 4 ml per square foot ink coverage, in this piezoelectric drop-on-demand ink jet printer, images that are bright, clear and intensely colored are produced in which the ink adheres to the crosslinked amine functional acrylic coated film.

The coated film as prepared above is also used as a substrate for screen printing. The film is cut into 8.5"×11" (22 cm×28 cm) samples and is screen printed by a laboratory draw down silk screen process. Some of the samples are printed with Sericol TM-311 white solvent based ink and some of the samples are printed with Sericol GSO-311 white UV cure ink. The samples printed with solvent based ink are then dried in a convection oven for 3 minutes at 150° F. (66° C.). The samples printed with UV cure ink are cured by passing through a Fusion UV cure chamber with a 400 watt mercury vapor bulb at 100 feet (30 meters) per minute. Each of these methods produces a blemish free dried ink that is resistant to peeling in the tape adhesion test.

What is claimed is:

1. A printable article comprising a substrate coated with hydrophobic, ink receptive polymer composition characterized by a solvent resistant fraction of at least about 0.6 and a solvent absorbance capacity of at least about 300% wherein said hydrophobic, ink receptive polymer composition comprises a crosslinked amine functional polymer.

2. The printable article of claim 1 wherein said hydrophobic, ink receptive polymer composition is characterized by a solvent resistance fraction of at least about 0.6 and a solvent absorbance capacity of at least about 800%.

3. The printable article of claim 1 wherein said solvent absorbance capacity of said hydrophobic, ink receptive polymer composition does not decrease by more than about 25% over a seven day period.

4. The printable article of claim 1 wherein said solvent absorbance capacity of said hydrophobic, ink receptive polymer composition does not decrease by more than about 10% over a seven day period.

5. The printable article of claim 1 wherein said hydrophobic, ink receptive polymer composition comprises an amine functional acrylic copolymer.

6. The printable article of claim 1 wherein said substrate is selected from a group consisting of polymer, metal, glass and paper.

7. The printable article of claim 6 wherein said polymer comprises a polymer selected from the group consisting of polyester, polycarbonate, polyolefin, vinyl chloride polymer and fluoropolymer.

8. The printable article of claim 6 wherein said polymer comprises a fluoropolymer.

9. The printable article of claim 8 wherein said fluoropolymer is selected from polymers and copolymers of trifluoroethylene, hexafluoropropylene, monochlorotrifluoroethylene, dichlorodifluoroethylene, tetrafluoroethylene, perfluorobutyl ethylene, perfluoro(alkyl vinyl ether), vinylidene fluoride, and vinyl fluoride and blends thereof and blends of said polymers with a nonfluoropolymer.

10. The printable article of claim 8 wherein said fluoropolymer is selected from polyvinyl fluoride, fluorinated ethylene/propylene copolymer, ethylene/tetrafluoroethylene copolymer, tetrafluoroethylene/perfluoro(alkyl vinyl ether)

copolymer, polyvinylidene fluoride and a blend of polyvinylidene fluoride and an acrylic polymer.

11. The printable article of claim 1 wherein said substrate comprises a polymer film.

12. The printable article of claim 1 wherein said substrate comprises a polymer sheet.

13. A printed article comprising a substrate coated with a layer of hydrophobic, ink receptive polymer composition characterized by a solvent resistant fraction of at least about 0.6 and a solvent absorbance capacity of at least about 300%, and an image formed on said layer by a non-aqueous solvent based ink wherein said hydrophobic, ink receptive polymer composition comprises a crosslinked amine functional polymer.

14. The printed article of claim 13 wherein said hydrophobic, ink receptive polymer composition is characterized by a solvent resistant fraction of at least about 0.6 and a solvent absorbance capacity of at least about 800%.

15. The printed article of claim 13 wherein said solvent absorbance capacity of said hydrophobic, ink receptive polymer composition does not decrease by more than about 25% over a seven day period.

16. The printed article of claim 13 said solvent absorbance capacity of said hydrophobic, ink receptive polymer composition does not decrease by more than about 10% over a seven day period.

17. The printed article of claim 13 wherein said substrate is selected from a group consisting of polymer, metal, glass and paper.

18. The printed article of claim 17 wherein said polymer comprises a polymer selected from the group consisting of polyester, polycarbonate, polyolefin, polyvinyl chloride and fluoropolymer.

19. The printed article of claim 17 wherein said polymer comprises a fluoropolymer.

20. The printed article of claim 19 wherein said fluoropolymer is selected from polymers and copolymers of trifluoroethylene, hexafluoropropylene, monochlorotrifluoroethylene, dichlorodifluoroethylene, tetrafluoroethylene, perfluorobutyl ethylene, perfluoro(alkyl vinyl ether), vinylidene fluoride, and vinyl fluoride and blends thereof and blends of said polymers with a nonfluoropolymer.

21. The printed article of claim 19 wherein said fluoropolymer is selected from polyvinyl fluoride, fluorinated ethylene/propylene copolymer, ethylene/tetrafluoroethylene copolymer, tetrafluoroethylene/perfluoro(alkyl vinyl ether) copolymer, polyvinylidene fluoride and a blend of polyvinylidene fluoride and an acrylic polymer.

22. The printed article of claim 13 wherein said substrate comprises a polymer film.

23. The printed article of claim 13 wherein said substrate comprises a polymer sheet.

24. The printed article of claim 13 wherein said image is formed using an inkjet printer.

25. The printed article of claim 13 wherein said image is formed using a screen printer.

26. A process for preparing a printable article comprising:

coating a substrate with a composition comprising a crosslinkable amine functional polymer and a crosslinking agent; and heating said coated substrate to a sufficient temperature to produce a crosslinked hydrophobic, ink receptive polymer layer on said substrate wherein said hydrophobic, ink receptive polymer layer is characterized by a solvent resistant fraction of at least about 0.6 and a solvent absorbance capacity of at least about 300%.

27. The process of claim 26 wherein said solvent absorbance capacity of said hydrophobic, ink receptive polymer composition does not decrease by more than about 25% over a seven day period.

28. The process of claim 26 wherein said solvent absorbance capacity of said hydrophobic, ink receptive polymer composition does not decrease by more than about 10% over a seven day period.

29. A process for preparing a printed article comprising:

coating a substrate with a composition comprising a crosslinkable amine functional polymer and a crosslinking agent;

heating said coated substrate to a sufficient temperature to produce a crosslinked hydrophobic, ink receptive polymer layer on said substrate wherein said hydrophobic, ink receptive polymer layer is characterized by a solvent resistant fraction of at least about 0.6 and a solvent absorbance capacity of at least about 300%; and forming an image on said crosslinked hydrophobic, ink receptive polymer layer by applying a non-aqueous solvent based ink.

30. The process of claim 29 wherein said solvent absorbance capacity of said hydrophobic, ink receptive polymer composition does not decrease by more than about 25% over a seven day period.

31. The process of claim 30 wherein said solvent absorbance capacity of said hydrophobic, ink receptive polymer composition does not decrease by more than about 10% over a seven day period.

* * * * *

UNITED STATES PATENT AND TRADEMARK OFFICE

CERTIFICATE OF CORRECTION

PATENT NO. : 7,608,311 B2
APPLICATION NO. : 10/980047
DATED : October 27, 2009
INVENTOR(S) : Larry Glen Snow It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1174 days.

Signed and Sealed this

Twelfth Day of October, 2010

David J. Kappos

David J. Kappos
*Director of the United States Patent and Trademark Office*